US005895270A

United States Patent [19]

Hempel, Jr.

[11] Patent Number: 5,895,270

[45] Date of Patent: Apr. 20, 1999

[54] CHEMICAL MECHANICAL POLISHING METHOD AND APPARATUS

[75] Inventor: Eugene O. Hempel, Jr., Garland, Tex.

[73] Assignee: Texas Instruments Incorporated, Dallas, Tex.

[21] Appl. No.: 08/669,731

[22] Filed: Jun. 26, 1996

Related U.S. Application Data

[60] Provisional application No. 60/000,565, Jun. 26, 1995.

[51] Int. Cl.[6] ..... B24B 7/04; B24B 1/00

[52] U.S. Cl. ..... 438/692; 216/89; 156/345; 451/41; 451/287

[58] Field of Search ..... 156/345 LP; 216/89; 438/692; 451/41, 287

[56] References Cited

U.S. PATENT DOCUMENTS

| | | | |
|---|---|---|---|
| 5,333,413 | 8/1994 | Hashimoto | 451/287 X |
| 5,433,650 | 7/1995 | Winebarger | 451/41 X |
| 5,527,424 | 6/1996 | Mullins | 438/692 |
| 5,534,106 | 7/1996 | Cote et al. | 451/287 X |
| 5,578,529 | 11/1996 | Mullins | 438/692 |
| 5,609,718 | 3/1997 | Meikle | 438/692 X |
| 5,647,789 | 7/1997 | Kitta et al. | 451/41 |
| 5,655,954 | 8/1997 | Oishi et al. | 451/67 |
| 5,738,574 | 4/1998 | Tolles et al. | 451/288 |

*Primary Examiner*—Bernard Codd
*Attorney, Agent, or Firm*—Mark A. Valetti; Carlton H. Hoel; Richard L. Donaldson

[57] ABSTRACT

An improved chemical mechanical polishing method of and apparatus (30) for performing CMP process on a plurality of semiconductor devices includes a plurality of carrier devices (14), each for receiving one of the plurality of semiconductor devices (22) such as a semiconductor wafer. A plurality of polishing pad mechanisms (12) associate with each of the carrier devices (14) so that each of the plurality of polishing pad mechanisms (12) separately and approximately simultaneously polishes one of the plurality of semiconductor devices (22). Control means controls the movement of each of the plurality of polishing pad mechanisms (12) relative to the associated semiconductor device (22) so that the semiconductor device (22) is separately polished. To minimize the adverse effects of gravity in the CMP process, the present invention may include a plurality of orienting mechanisms (38) for orienting each of the plurality of carrier devices (14) and each of the plurality of polishing pad mechanisms (12) in the vertical plane.

6 Claims, 3 Drawing Sheets

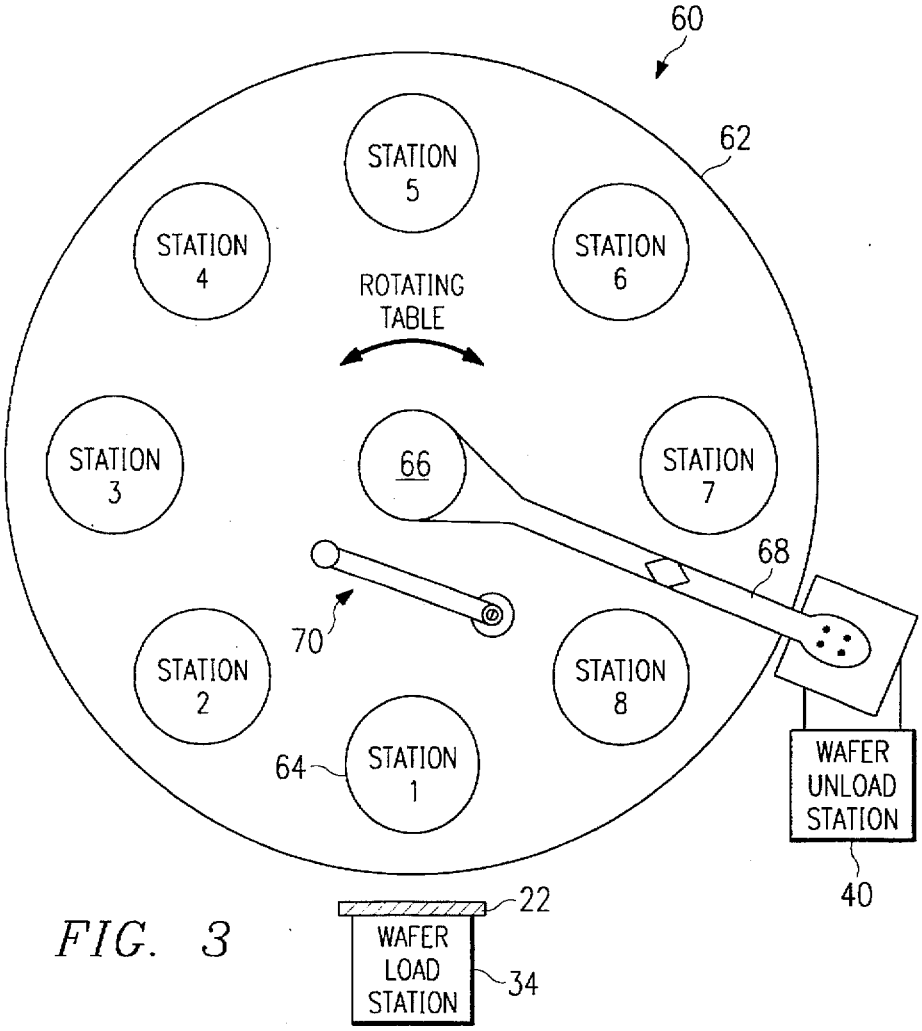
FIG. 3
FIG. 4
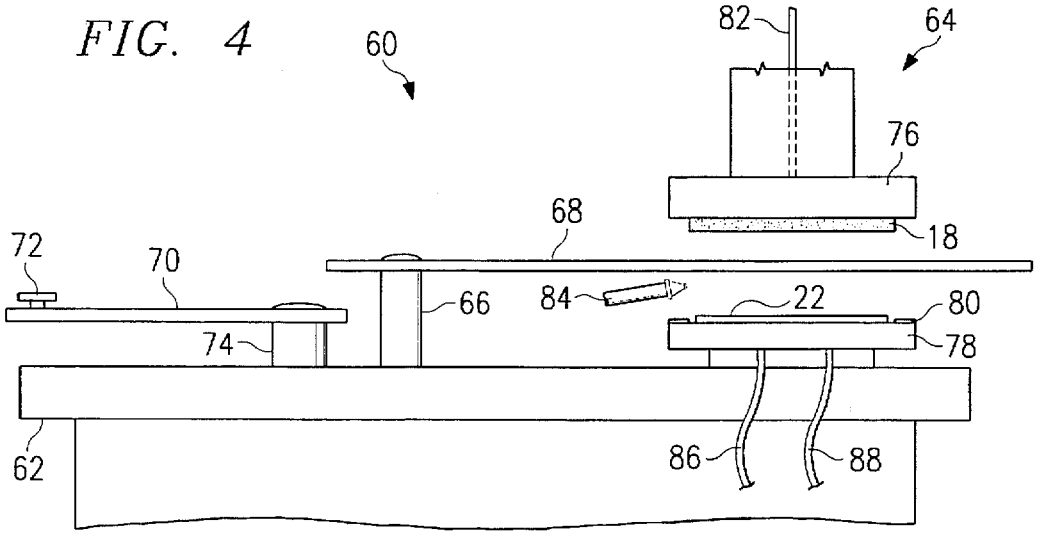

CHEMICAL MECHANICAL POLISHING METHOD AND APPARATUS

This application claims priority under 35 USC §119(c)(1) of provisional application number 60/000,565, filed Jun. 26, 1995.

TECHNICAL FIELD OF THE INVENTION

The present invention relates to a method of and system for processing a semiconductor device and, more particularly, to a method of and apparatus for performing chemical mechanical polish (CMP) processing of a semiconductor device that results in greater device surface uniformity and lesser edge exclusion to yield improved semiconductor device performance characteristics.

BACKGROUND OF THE INVENTION

Advances in electronic devices generally include reducing the size of the components that form integrated circuits. With smaller circuit components, the value of each unit area of a semiconductor wafer becomes higher. This is because the ability to use all of the wafer area for integrated circuit components improves. To properly form an integrated circuit that employs a much higher percentage of usable wafer area, it is critical that contaminant particle counts on the semiconductor wafer surface be reduced below levels which previously may have been acceptable. For example, minute particles of oxides and metals of less than 0.2 microns are unacceptable for many of the popular advanced circuit designs, because they can short out two or more conducting lines.

In order to planarize a semiconductor wafer and to remove unwanted particles, chemical mechanical polishing or chemical mechanical polish (hereinafter "CMP") process has become popular. CMP systems place a semiconductor wafer in contact with a polishing pad that rotates relative to the semiconductor wafer. The semiconductor wafer may be stationary, or it may also rotate on a carrier that holds the wafer. Problems of conventional methods of performing a chemical mechanical polish is that they produce nonuniform wafers and produce larger than desirable edge exclusion areas. Both of these problems impair operation of resulting electronic components formed from the semiconductor devices. Semiconductor wafer non-uniformity may cause undesirable layers not to be removed at some places and desirable layers to be removed at other places on the wafer surface. This causes various areas on the wafer surface to be unusable for forming semiconductor devices. Process uniformity from wafer to wafer is also important in CMP processing. Known CMP systems, however, suffer from significant wafer-to-wafer non-uniformities. This can also adversely affect the throughput and yield of the CMP process. Edge exclusion occurs when too much of the semiconductor wafer surface is polished at the edge of the wafer. This causes the outer edge of the wafer to be unusable for applications such as semiconductor device fabrication.

Another problem of known methods of and systems for chemical mechanical polishing a semiconductor device is that they have throughput limitations. Wafer polish throughput, like polish uniformity is an important process parameter because it directly affects the number of integrated circuits or other applications for which the fabrication facility may supply components for a given period of time.

SUMMARY OF THE INVENTION

Therefore, a need has arisen for an improved method and system for performing a CMP process on a semiconductor device, such as a semiconductor wafer or a compact disc.

There is a need for a CMP method and system that provides greater uniformity in the resulting semiconductor device surface than that provided by existing CMP processing methods and systems.

There is a further need for CMP processing method and system that substantially reduces edge exclusion in semiconductor devices that receive the CMP polishing.

There is yet a further need for CMP method and system with greater throughput than currently exists with known CMP methods and systems.

Still a further need exists for a CMP method and system that extends the useful life of polishing pad conditioners and, thereby, reduces costs associated with processing the semiconductor devices.

In accordance with the present invention, therefore, a method and system for CMP processing of a semiconductor device is provided that substantially eliminates or reduces disadvantages and problems associated with previously developed CMP processing methods and systems.

More specifically, the present invention provides a method for performing a CMP process on a plurality of semiconductor devices. The method includes the steps of placing a plurality of semiconductor devices on a plurality of carrier devices. Each of the plurality of carrier devices are associated to permit approximately simultaneous polishing of the plurality of semiconductor devices. Polishing the plurality of semiconductor devices with a plurality of polishing pad mechanisms is another step of the present method. With the present invention, each of the plurality of semiconductor devices separately associates with one of the plurality of polishing pad mechanisms. The method may also be configured so that the plurality of semiconductor devices and the plurality of polishing pad mechanisms are oriented vertically to cause the faces of each semiconductor device and each polishing pad mechanism to be parallel to the direction of gravitational forces.

Another aspect of the present invention is an apparatus for performing a CMP process on a plurality of semiconductor devices. The apparatus includes a plurality of carrier devices, each for receiving one of the plurality of semiconductor devices. A plurality of polishing pad mechanisms associate with each of the carrier devices so that each of the plurality of polishing pad mechanisms separately and approximately simultaneously polishes one of the plurality of semiconductor devices. Control circuitry controls the movement of each of the plurality of polishing pad mechanisms relative to the associated semiconductor devices so that each semiconductor device is separately polished. To minimize the adverse effects of gravity in the CMP process, the present invention may include a plurality of orienting mechanisms for orienting each of the plurality of carrier devices and each of the plurality of polishing pad mechanisms in the vertical plane.

A technical advantage of the present invention is that it increases the throughput for the CMP portion for semiconductor device processing by permitting numerous semiconductor devices to undergo the CMP process in an approximately simultaneous manner. For example, within the time that a single wafer may be processed using a conventional CMP method, the present invention may process four or more semiconductor devices.

Another technical advantage that the present invention provides is greater semiconductor device uniformity over prior CMP methods and systems. Because each semiconductor device has a separate associated polishing pad mechanism, the present invention provides the ability to specifically control the pressure between the polishing pad and the semiconductor device, the application of slurry, and the CMP processing time. The result is a more controlled CMP process.

Yet another technical advantage of the present invention is that it helps to extend the useful life of CMP polishing pads. The present invention permits the use of a polishing pad mechanism having a smaller polishing pad that is preferably formed to polish a single semiconductor device. As such, there is not the need for a conditioning device to sweep across the polishing pad surface in conditioning the polishing pad. This avoids trenches that develop in conventional polishing pads and that reduce the effective life of the polishing pad. Because the individual polishing pads do not develop these trenches, their useful life is often greater than that of polishing pads used in conventional methods and systems. This could have the effect of making the CMP process more economical and reducing the total costs of semiconductor device fabrication.

Still other technical advantages of the present invention are that the method and system have yield minimal downtimes due to equipment failures relative to known multistage CMP processing systems and may easily accommodate innovations and improvements in the CMP process. The present invention supports the modular attachment of both carrier devices and polishing pad mechanisms that may be easily connected and disconnected. Therefore, failed polishing mechanisms or carrier devices may be easily replaced with little down-time for ongoing CMP processing. Moreover, as innovations in polishing pad mechanisms and carrier devices arise, the modifications may be incorporated in new pad mechanisms and carrier devices that can replace the corresponding older components that are already in use.

These and other technical advantages will become more apparent with an understanding of the description of illustrative embodiments of the invention that the appended claims cover.

BRIEF DESCRIPTION OF THE DRAWINGS

Accordingly, reference is now made to the following description which is to be taken in conjunction with the accompanying drawings in which like reference numerals indicate like features and wherein:

FIG. 3 depicts a top-down view of an alternative embodiment of the present invention; and FIG. 4 is a side view of the embodiment of FIG. 3.

DETAILED DESCRIPTION OF THE INVENTION

Preferred embodiments of the present invention are illustrated in the FIGURES where like numerals refer to like and corresponding parts of the various drawings.

Figure 1:
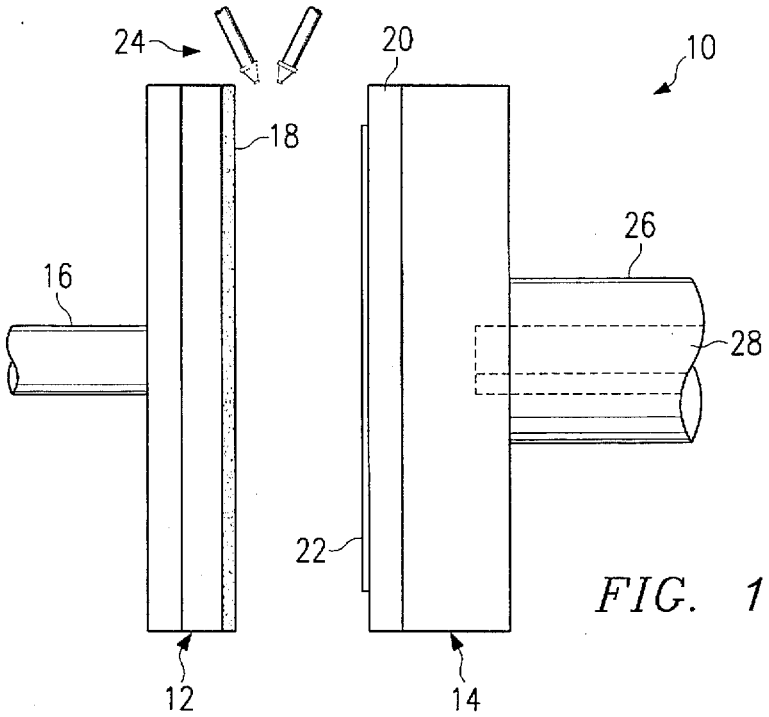
FIG. 1 illustrates one embodiment of the CMP polishing pad and carrier device combination of the present invention.

FIG. 1 shows configuration 10 that includes platen 12 and carrier device 14. Platen spindle 16 holds platen 12, which may be heated by an internal heater of many possible forms. Platen 12 holds pad 18 by adhesive force. Carrier device 14 includes carrier ring 20 for holding semiconductor device 22, which may be a semiconductor wafer or other similar device, by vacuum or other force. To maintain a slurry coating on polishing pad 18, slurry source 24 applies a slurry coating to polishing pad 18. In the embodiment of FIG. 1, two independent slurry sources appear to ensure a desired degree of slurry coating for polishing pad 18. Spindle 26 supports carrier device 14 and includes channel 28 for permitting vacuum and air flow to carrier ring 20. This permits a vacuum force to reach semiconductor device 22 that holds semiconductor device 22 to carrier ring 20. Channel 28 also provides a path for air flow to apply a back pressure air supply to the backside of semiconductor device 22.

Figure 2:
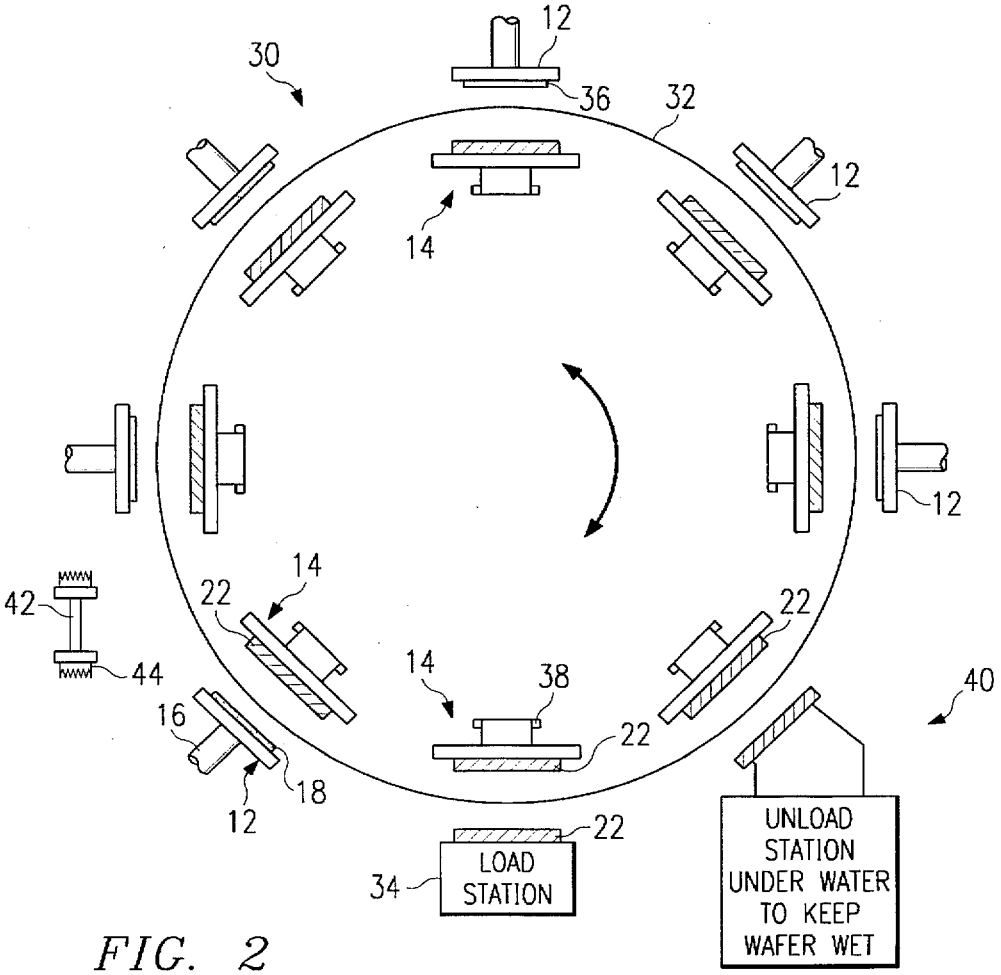
FIG. 2 shows a top-down view of one embodiment of a system incorporating the concepts of the present invention.

FIG. 2 shows a top-down view of CMP apparatus 30 of the present embodiment which includes rotating table 32 on which numerous carrier devices 14 attach and rotate to hold semiconductor device 22. Each carrier device 14 is positioned so that it may engage an associated polishing pad mechanism 12. While the embodiment of FIG. 2 shows six carrier device 14 and polishing pad mechanism 12 combinations, other numbers of combinations may work well. This may depend on the size of semiconductor device 22 and the throughput objectives for the CMP process, as well as other process parameters. In operation, a carrier device 14 is positioned to receive a semiconductor device 22 from load station 34. Carrier devices 14 are positioned around the perimeter of rotating table 32 in a position corresponding to the various positions of polishing pad mechanisms 12. Each carrier device 14 may be positioned with an orienting device 38 that causes the face of semiconductor wafer 22 and carrier device 14 to be vertical and perpendicular to the horizontal surface of rotating table 32. Each polishing pad mechanism 12 may include a polishing pad 18 or a final buffing pad 36.

In operation, load station 34 provides to carrier device 14 a semiconductor wafer. Carrier device 14 receives the semiconductor wafer 22 and, by vacuum or other force, holds semiconductor wafer 22 in place. Thereafter, rotating table 32 may rotate clockwise to position carrier device 14 opposite polishing pad mechanism 12. Carrier device 14 rotates about spindle 26 at an optimal speed determined by the desired degree of CMP processing. Polishing pad mechanism 12 may also rotate in a direction opposite the rotation of carrier device 14. As polishing pad 18 and semiconductor device 22 rotate, they come in contact with one another by the positioning of polishing pad mechanism 12 for polishing semiconductor wafer 22.

If a user desires to polish more than one semiconductor wafer 22 at a time, carrier devices 14 may be loaded with a semiconductor device 22. Rotating table 32 may then be rotated so that three carrier devices 14 align with three polishing pad mechanisms 12, each having an associated polishing pad 18 for polishing semiconductor wafer 22. After polishing, the three carrier devices 14 containing the polished semiconductor wafers 22 may be rotated to the corresponding three polishing pad mechanisms 12, each having an attached final buffing pad for finishing the CMP process. Then, after polishing, each individual carrier device 14 may rotate to unload station 40. Unload station 40 receives the polished and buffed semiconductor wafer 22.

CMP polish mechanism improves the planarity of a semiconductor wafer and decreases the undesirable edge exclusion because of the many improvements that the present embodiment provides. One such improvement is the vertical orientation of polishing pad mechanism 12 and carrier device 14. The present device produces improved results because gravitational forces that otherwise would hold particulate matter on the surface of either polishing pad 18 or semiconductor wafer 22 do not exist. If particulate is removed from polishing pad 18 or semiconductor wafer 22, due to gravitational forces the particulate simply falls to the surface of rotating table 32, and not to the polishing pad 18 or semiconductor wafer 22 surface. Another advantage of the present embodiment is that polishing pad 18 is smaller in size that prior polishing pads. This permits more precise control of edge exclusion problems that occur in many semiconductor devices that are processed by CMP.

Polishing pad mechanism 12 may be configured to rotate not only about the axis of spindle 16, but also in a horizontal and vertical direction or, perhaps, in an orbital direction by changing the position of spindle 16. The rotational speed of carrier device 14 and polishing pad mechanism 12 may be varied or fixed, depending on desired results. Also, the rotation of carrier device 14 may be varied in speed. Different pressures may also be applied between polishing pad mechanism 12 and carrier device 14 according to the desired polishing results.

Another technical advantage of the present embodiment is that it provides CMP processing for multiple semiconductor devices without the associated limitations from which known multiple spindle devices suffer. In existing multiple wafer processing, the semiconductor devices undergoing CMP processing contact, usually in a horizontal plane, a single polishing pad. With the present embodiment, however, separate polishing pads 18 associate with each semiconductor device 22 so that process parameters for each semiconductor device 22 may be adjusted and more closely monitored. Thus, the throughput advantages of a multiple spindle apparatus are obtained with the present invention, together with significantly improved process control. The result is greater surface uniformity and be desirable results of less edge exclusion due to non-uniformity.

The loading and unloading operation of the present embodiment is also significantly simpler than that of existing CMP systems because semiconductor device 22 is oriented in a vertical plane. That is, from load station 34, semiconductor device 22 may be selected and initially positioned in the vertical plane. Then, during both the initial wafer polishing by polishing pad 18 and the subsequent final polishing or buffing by buffing pad 36, as well as the final placement of semiconductor device 22 in unload station 40, semiconductor device 22 maintains a vertical orientation. This inherent simplicity also makes the present embodiment economical to use and maintain. Because of the simple operating mechanics that CMP apparatus 30 employs, maintenance and repair of the present system should be minimal and should ultimately help device fabrication costs.

The control of the back pressure to semiconductor device 22 may be controlled within carrier device 14. This will assist in maintaining desired levels of planarity and uniformity across semiconductor device 22 as a result of the CMP process. Moreover, the present embodiment provides the additional advantage of permitting control of gimbling action and physical positioning of carrier devices 14. Also, the present embodiment includes the capability to move rotating table 42 in either a clockwise or counterclockwise direction to select different positions of carrier device 14 and selectively positioning a semiconductor device 22 in contact with a polishing pad 18 or a final buffing pad 36.

After polishing a semiconductor device 22, polishing pad 18 should be conditioned. For this purpose, the conditioning device 42 may be included with the present embodiment. Thus, each spindle 16 for polishing pad mechanism 12 could pivot polishing pad 12 to come in contact with the conditioning surface 44 of conditioning device 42.

The present embodiment of the invention may be operated in a serial or parallel mode by changing control software to operate the system in such a mode. Moreover, system control software and machine control instructions may be included as well as a process control computer to achieve desired system operating characteristics. Although not shown in FIG. 2, the present embodiment includes control circuitry with necessary sensors and switches to determine the position of carrier devices 19 and polishing pad mechanisms 12 relative to one another. Pressure sensors and servo motors are employed to precisely control the movement of the various components of the present embodiment.

The present embodiment of the invention may be used in conjunction with numerous modifications to the CMP process by the inventor hereof and which are assigned to Texas Instruments Incorporated of Dallas, Tex. For example, U.S. Pat. No. 5,597,346, entitled "Method and Apparatus for Holding a Semiconductor Wafer During a Chemical Mechanical Polish (CMP) Process" by G. Hempel describes an improved carrier device and method of using the device. The improvement of this U.S. Patent may be incorporated into carrier device 14 of the present embodiment. Also, U.S. Pat. No. 5,597,443, entitled "Method and System for Chemical Mechanical Polishing of Semiconductor Wafers," also by G. Hempel describes an improved method of removing slurry from a polished semiconductor wafer. During the polishing of semiconductor device 22, this improved method may be applied to remove slurry from semiconductor device 22 in preparation for buffing by final buffing pad 36. In addition, U.S. Pat. No. 5,609,719, entitled "Method and Apparatus for Chemical Mechanical Polish (CMP) of A Wafer," also by G. Hempel, describes an improvement to polishing pad 18 that maintains a more uniform slurry across the polishing pad 18 surface. Polish pad 18 may include the improvement of this application. Consequently, all of the above-referenced U.S. patent applications are herein incorporated by reference.

FIGS. 3 and 4 illustrate an alternative embodiment of the present invention as multi-stage CMP polishing device 60 that has a horizontal orientation. Horizontal multi-stage CMP polishing device 60 includes rotating table 62 on which there are numerous CMP process stations 64, which are here numbered 1 through 8. At the center of rotating table 62 appears base 66 of robot arm 68 that controls the positioning of semiconductor devices 22. Pad conditioning arm 70 is positioned to condition polishing pads at each of the eight stations 64 on rotating table 62. Wafer load station 34 provides semiconductor devices 22 that may be positioned at each station 64. After polishing, robot arm 68 removes the polished semiconductor device 22 from the polish station and places it in unload station 40.

FIG. 4 shows a side view of the configuration of each station 64 of multi-stage CMP polishing device 60. As FIG. 4 indicates, on rotating table 62 appears pad conditioning arm 70 including pad conditioner 72. Pad conditioning arm 70 attaches to rotating table 62 at base 74. Robot arm 68 attaches to rotating table 62 at base 66 and passes between polishing pad mechanism 76 that holds polishing pad 18. Carrier device 78 includes carrier ring 80 and holds semiconductor device 22. The slurry channel 82 of polishing pad mechanism 76 directs slurry to polishing pad 18 so that as polishing pad mechanism 76 lowers polishing pad 18 in contact with semiconductor device 22, a slurry coating exists between polishing pad 18 and semiconductor device 22. After polishing, water spray mechanism 84 may apply either deionized water or a combination of deionized water and a pH controlling substance, such as ammonium hydroxide, to the surface of semiconductor device 22. To maintain semiconductor device 22 in position, carrier device 78 may apply vacuum by way of vacuum line 86. To remove water from the surface of carrier ring 80, water lines 88 attach to carrier ring 80.

With the alternative embodiment of multi-stage CMP processing apparatus 60, semiconductor device 22 is horizontal, but has a separate polishing pad 18 for embodying the many advantages associated with the method and system of FIGS. 1 and 2.

Figure 5:
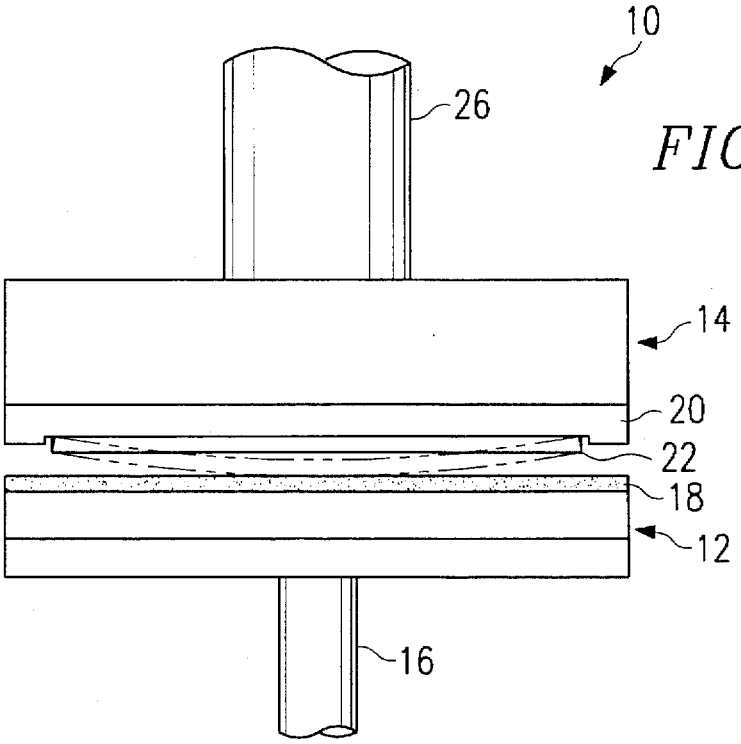
FIG. 5 is a side view illustrating a chemical-mechanical polishing tool of one embodiment.
Figure 6:
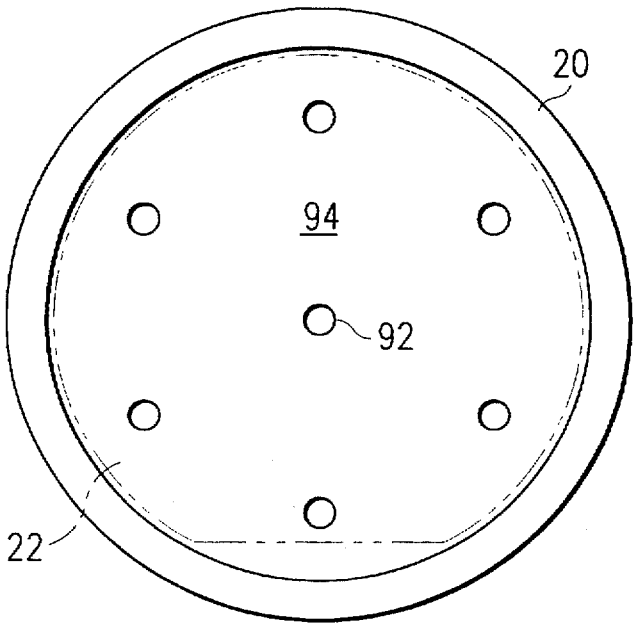
FIG. 6 is the carrier device of the instant invention as illustrated in FIG. 5.

While semiconductor device 22 is positioned on carrier device 14 and in contact with pad 18, both a downward force and back pressure may be applied. The downward force places semiconductor device 22 in contact with pad 18 for polishing. FIGS. 5 and 6 show views of carrier device 14 to indicate the effect and source of back pressure air flow. Back pressure air flow, as FIG. 5 shows, causes a slight extension of the center of semiconductor device 22. This promotes more uniform polishing of semiconductor device 22. FIG. 6 shows that apertures 92 in face 94 of carrier device 14 form a showerhead array that uniformly applies air flow to the semiconductor device 22 backside.

In operation, semiconductor device 22 is removed from load cassette 34 through the use of robot arm 68 and placed on any station 64 that the user may desire to receive semiconductor device 22. This permits multi-stage CMP apparatus 60 to polish and buff different semiconductor devices 22 for different processing times on each station 64. The alternative multi-stage CMP processing system 60, therefore, provides the ability to rotate carrier device 78 at different speeds. In addition, different back pressures may be applied on semiconductor device 22 to increase planarity and minimize non-uniformity of semiconductor device 22. As mentioned in conduction with the apparatus of FIGS. 1 and 2, polishing pad mechanism 76 may be moved in an "X" and "Y" direction, as it rotates, or in an orbital direction as it rotates to prevent uneven wearing of polishing pad 18. Dispensing slurry through polishing pad 18, eliminates hot spots at the center of semiconductor device 22. This further improves the ability for increased planarity and eliminating non-uniformity of semiconductor device 22. Again, the above-stated improvements in the related U.S. patent applications by the inventor hereof may be used with multi-stage CMP apparatus 60 of FIGS. 3 and 4. Conditioning arm 70 of FIGS. 3 and 4 may be configured to condition polishing pad 18 either before or after polishing pad 18 polishes semiconductor device 22. The timing of conditioning may vary, for example, according to the desired characteristics of the resulting semiconductor device 22.

As can be seen from the CMP processing apparatus of FIGS. 1 through 4, improvements that the present embodiments provide include greater CMP process uniformity for the semiconductor device 22 surface, as well as greater wafer-to-wafer process uniformity, greater throughput for performing the CMP processing of semiconductor devices 22, and greater control of the CMP process for each individual semiconductor device 22 with a multi-spindle CMP system. Another enhanced feature of the present method and system is that each carrier device 14 and 78, as well as each polishing pad mechanism 12 and 76, may be formed as a modular unit. As a modular unit, each polishing pad mechanism or carrier device may be machined as a device that may be "snapped in" or quickly disconnected in the event of a problem with the rotating mechanism or other mechanical aspects. By simply replacing a defective polishing pad mechanism or carrier device, downtime in the event of equipment malfunction is minimal.

A semiconductor device 22 on which the present embodiment may perform a CMP process could be a semiconductor wafer, a compact disc, or other semiconductor device for which a CMP process provides the desired particulate removal and planarity adjustments to improvement component performance. Although the present embodiment may usually accommodate six-inch and eight-inch wafers, wafers with diameters of up to twelve inches and beyond may be processed with an appropriate-sized embodiment of the present invention. In addition, other modifications of the embodiments of FIGS. 1 through 4 may be derived according to the specific processing requirements of the semiconductor device 22.

Although the invention has been described in detail herein with reference to the illustrative embodiments, it is to be understood that this description is by way of example only and is not to be construed in a limiting sense. It is to be further understood, therefore, that numerous changes in the details of the embodiments of the invention and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A method for performing a chemical-mechanical polishing process on a plurality of semiconductor devices, comprising the steps of:

placing a first plurality of semiconductor devices on a first plurality of carrier devices and a second plurality of semiconductor devices on a second plurality of carrier devices;

polishing the first plurality of semiconductor devices with a plurality of polishing pad mechanisms so that each of the first plurality of semiconductor devices separately associates with one of the plurality of polishing pad mechanisms;

buffing the second plurality of semiconductor devices with a plurality of buffing pad mechanisms so that each of the second plurality of semiconductor devices separately associates with one of the plurality of buffing pad mechanisms;

and wherein said polishing step and said buffing step are performed simultaneously.

2. The method of claim 1, wherein said polishing a plurality of semiconductor devices step comprises the step of polishing a plurality of semiconductor wafers.

3. The method of claim 1, further comprising the step of separately coating each of the plurality of polishing pads within a slurry for lubricating the interface between the polishing pad and the semiconductor device.

4. The method of claim 1, further comprising the step of conditioning each of said plurality of polishing pads using a conditioning device adjacent to each of the plurality of polishing pad mechanisms.

5. The method of claim 1, further comprising the step of positioning said plurality of carrier devices on a rotating table for positioning the carrier devices in association with the polishing pad mechanisms.

6. The method of claim 1, further comprising the steps of receiving the plurality of semiconductor devices from a semiconductor device load station and inserting polished semiconductor devices in a semiconductor device unload station.

* * * * *